US006315617B1

(12) United States Patent
Al-Sabah

(10) Patent No.: US 6,315,617 B1
(45) Date of Patent: Nov. 13, 2001

(54) APPARATUS AND METHOD FOR DISTRIBUTING POWER FROM A POWER SUPPLY

(76) Inventor: Sabah Naser Al-Sabah, P. B. 36777, Al-Ras, 24758 (KW)

( * ) Notice: Subject to any disclaimer, the term of this patent is extended or adjusted under 35 U.S.C. 154(b) by 0 days.

(21) Appl. No.: 09/166,952

(22) Filed: Dec. 31, 1998

Related U.S. Application Data

(63) Continuation-in-part of application No. 29/085,708, filed on Mar. 27, 1998, now Pat. No. Des. 406,562.

(51) Int. Cl.[7] ..... H01R 25/00
(52) U.S. Cl. ..... 439/652
(58) Field of Search ..... 439/652, 656, 439/651, 653, 221–224; 174/66; 220/241

(56) References Cited

U.S. PATENT DOCUMENTS

| | | | | |
|---|---|---|---|---|
| D. 276,225 | | 11/1984 | Powel . | |
| D. 406,562 | * | 3/1999 | Al-Sabah | D13/137.2 |
| 3,938,068 | | 2/1976 | Hagan . | |
| 3,997,225 | | 12/1976 | Horwinski . | |
| 4,659,161 | | 4/1987 | Holcomb . | |
| 4,767,359 | | 8/1988 | Martell . | |
| 4,856,999 | | 8/1989 | Flohr . | |
| 4,867,701 | | 9/1989 | Wiand . | |
| 5,094,630 | | 3/1992 | Jammet . | |
| 5,142,163 | * | 8/1992 | Hase | 307/64 |
| 5,211,584 | | 5/1993 | Lee . | |
| 5,383,799 | | 1/1995 | Fladung . | |
| 5,616,968 | * | 4/1997 | Fujii et al. | 307/66 |
| 5,658,158 | | 8/1997 | Milan . | |
| 5,660,554 | | 8/1997 | Mead . | |

* cited by examiner

*Primary Examiner*—Neil Abrams
*Assistant Examiner*—J. F. Duverne
(74) *Attorney, Agent, or Firm*—Allen, Dyer, Doppelt, Milbrath & Gilchrist, P.A.

(57) ABSTRACT

An apparatus and method for distributing power from a main power supply line, the apparatus including a main power distribution module; a main power line connector for electrically engaging with the main power supply line; and a plurality of auxiliary power line connector receptacles for receiving auxiliary power line connector pins therein and distributing power thereto. A plurality of auxiliary power distribution modules is connected to the main power distribution module, each one including a plurality of auxiliary power line connector pins extending therefrom for electrically engaging with one of the plurality of auxiliary power line connector receptacles of the main housing, and at least one auxiliary power line connector receptacle for receiving a plurality of auxiliary power line connector pins.

25 Claims, 9 Drawing Sheets

Fig. 1.
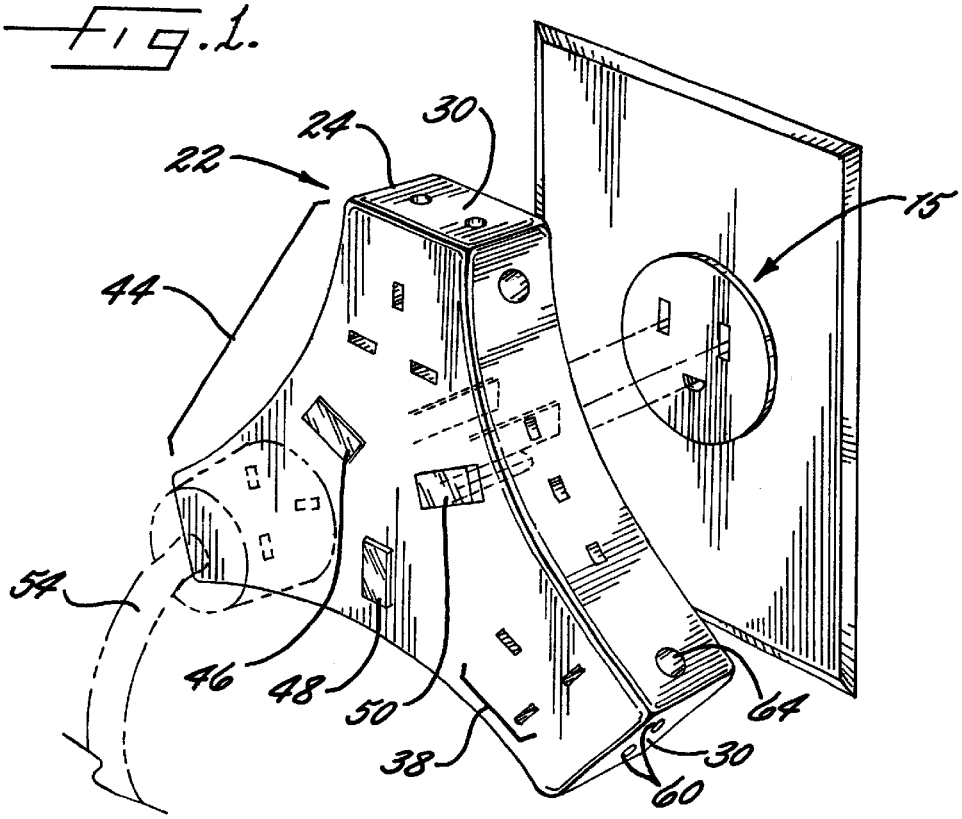
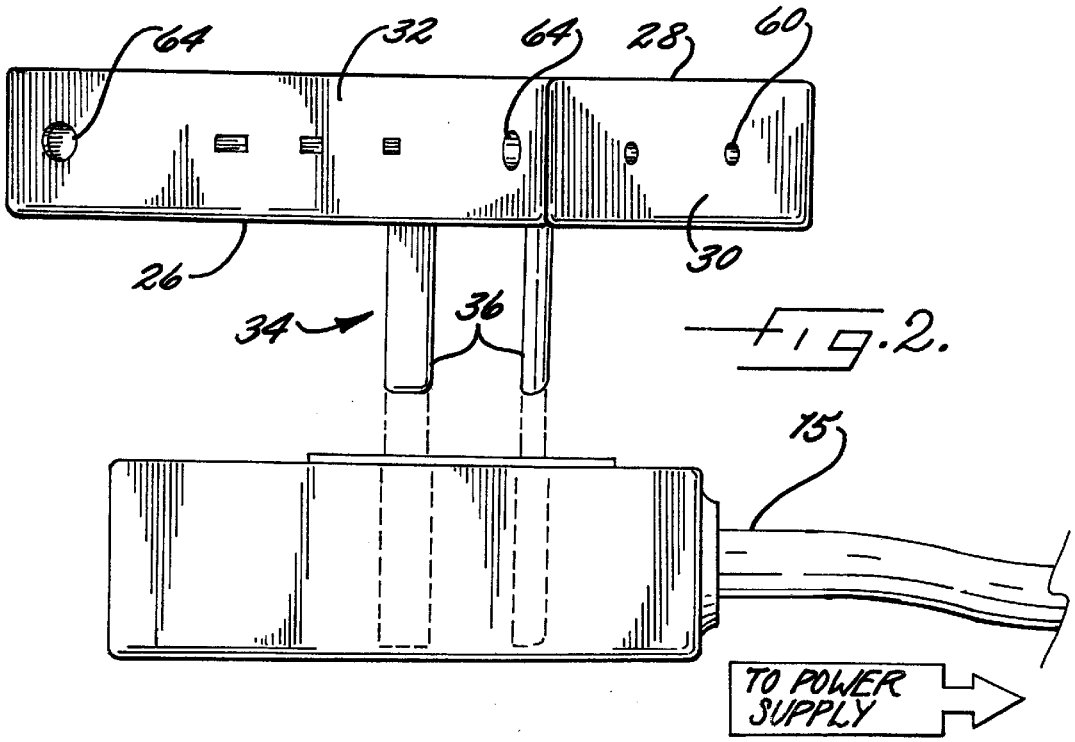
Fig. 2.

APPARATUS AND METHOD FOR DISTRIBUTING POWER FROM A POWER SUPPLY

RELATED APPLICATIONS

This application is a continuation-in-part of U.S. patent application Ser. No. 29/085,708, which was filed on Mar. 27, 1998, and which is incorporated herein by reference in its entirety.

FIELD OF THE INVENTION

The present invention relates to the field of electrical power distribution and, more particularly to distribution of electrical power from a main power supply line to auxiliary power lines and devices.

BACKGROUND OF THE INVENTION

Power distribution from a main power supply line to multiple power connections has generally been accomplished by multiple-outlet electrical extension cords well known in the art. Such an extension cord device is connected to a main power line, or source of electric power, and provides a plurality of electrical connector outlets for connecting auxiliary power lines or electrical devices. Most of these extension cords make no provision for attaching extra connector outlets which allow for connection of additional power lines or electrical devices.

Many of these well known power distribution strips, such as now commonly used for connection of desk top computer equipment, include overload protection by way of a fuse or a circuit breaker. In addition, these power strip devices often incorporate a manual on-off switch, allowing the user to interrupt the flow of electric power from the main power supply line to the auxiliary outlets. Standard power strips, such as often used for connecting personal computers to a source of electrical power, illustrate these features but do not provide the user with the flexible choice of adding or subtracting control features, such as circuit breakers, on-off switches, overload indicators, timers, and the like.

Multiple socket attachment devices, also well known in the art, are used to connect to an electrical wall socket for distributing power therefrom to a plurality of additional connector receptacles provided on the device, multiplying the number of available outlets from the usual two located at the wall outlet, to six, eight, or sometimes more. Multiple socket devices provide the user with a fixed number of added connector outlets, a number over which the user has no control. If the user wishes to add outlets to such a device, additional multiple socket units must be connected on top of the first multiple socket device, creating a bulky, unsightly and unsafe arrangement that projects out from the electrical outlet on the wall.

SUMMARY OF THE INVENTION

With the foregoing in mind, the present invention advantageously provides an apparatus for distributing electrical power from a main power line to a plurality of auxiliary power line connector receptacles, and advantageously provides capabilities not afforded by existing power distribution devices, in that it allows the user to adjust the number of available electrical outlets available, provides various combinations of power control functions, and maintains a relatively slim profile against a wall outlet.

The apparatus includes a main power distribution module and auxiliary power distribution modules which connect to the main power distribution module. The main power distribution module has a main housing which allows the user to matingly connect auxiliary power distribution modules to the main housing, thus allowing the user to easily add outlets to the device. The power distribution apparatus also allows flexible choice in the number and type of electrical function devices positioned to control those electrical outlets by providing those control functions not only on the main power distribution module, but also through the auxiliary power distribution modules which may be additionally connected to the main module. The main housing is shaped to provide recessed side walls which matingly accept the complementary shape of the connecting auxiliary power distribution modules and, thereby, allows for adding electrical outlets to the apparatus while maintaining a slim profile against a wall outlet. The present invention, thus, provides a solution to the bulky, unsightly and unsafe combination of multiple socket outlets stacked one upon the other.

The main power distribution module includes a main power line connector, a main housing, and a plurality of auxiliary power line connector receptacles formed on the main housing. The main power line connector essentially includes connector pins extending from the main housing for electrically engaging with a main power supply line, usually by connecting to a wall electrical outlet. The main housing has a bottom wall, a top wall, three substantially planar spaced-apart side walls, and three recessed spaced-apart side walls each connected to and extending between two of the three substantially planar spaced-apart side walls. In a preferred embodiment, the recessed side walls provide arc shaped hollows into which fit the complementary shapes of the auxiliary power distribution modules. The main housing further includes one or more auxiliary power line connector receptacles, preferably located on the top wall of the main housing, for connecting auxiliary power lines, electrical devices and the like, for obtaining power. In addition, the main housing may include added features, such as a power disconnect switch, a power overload warning indicator, a circuit breaker, a timer switch, or any combination of these functions.

The apparatus also includes one or more auxiliary power distribution modules, having a shape complementary in fit to the arc shaped hollows created on the main power distribution module by its recessed side walls. Each auxiliary power distribution module includes an auxiliary power line connector receptacle to which an auxiliary power line may be connected for obtaining electrical power. In addition, each auxiliary power distribution module may be disposed with the same added power control features as the main power distribution module, such as a power disconnect switch, a power overload warning indicator, a circuit breaker, a timer switch, or any combination of these functions.

The apparatus may also be disposed with a power converter for conversion of electrical power from standard American 110 Volt alternating current to standard European 220 Volt power. The apparatus may also be configured to convert alternating current, from either American or European voltage to 12 Volt direct current. Additionally, the apparatus may include a current converter to change 15 Amp current to 30 Amp current, or vice versa.

The present invention also includes methods for distributing power from a main power supply line to auxiliary lines by electrically connecting a main power distribution module to the main power supply line, electrically connecting at least one auxiliary power distribution module to the main power distribution module so that an outer surface of the auxiliary power distribution module abuttingly contacts an outer surface of the main power distribution module, and by providing a power function device on the auxiliary power distribution module for responsively interacting with the power being distributed from the main power supply line to the auxiliary power distribution module.

BRIEF DESCRIPTION OF THE DRAWINGS

Some of the features, advantages, and benefits of the present invention having been stated, others will become apparent as the description proceeds, when taken in conjunction with the accompanying drawings in which:

FIG. 1 is an exploded perspective view of the main power distribution module according to an embodiment of the present invention, illustrating how it connects to a wall outlet for a main power supply line and, shown in phantom view, how an auxiliary power line connects to the module;

FIG. 2 is a rear elevational view of the main power distribution module, showing how it connects to a main power supply line;

DETAILED DESCRIPTION

Figure 3:
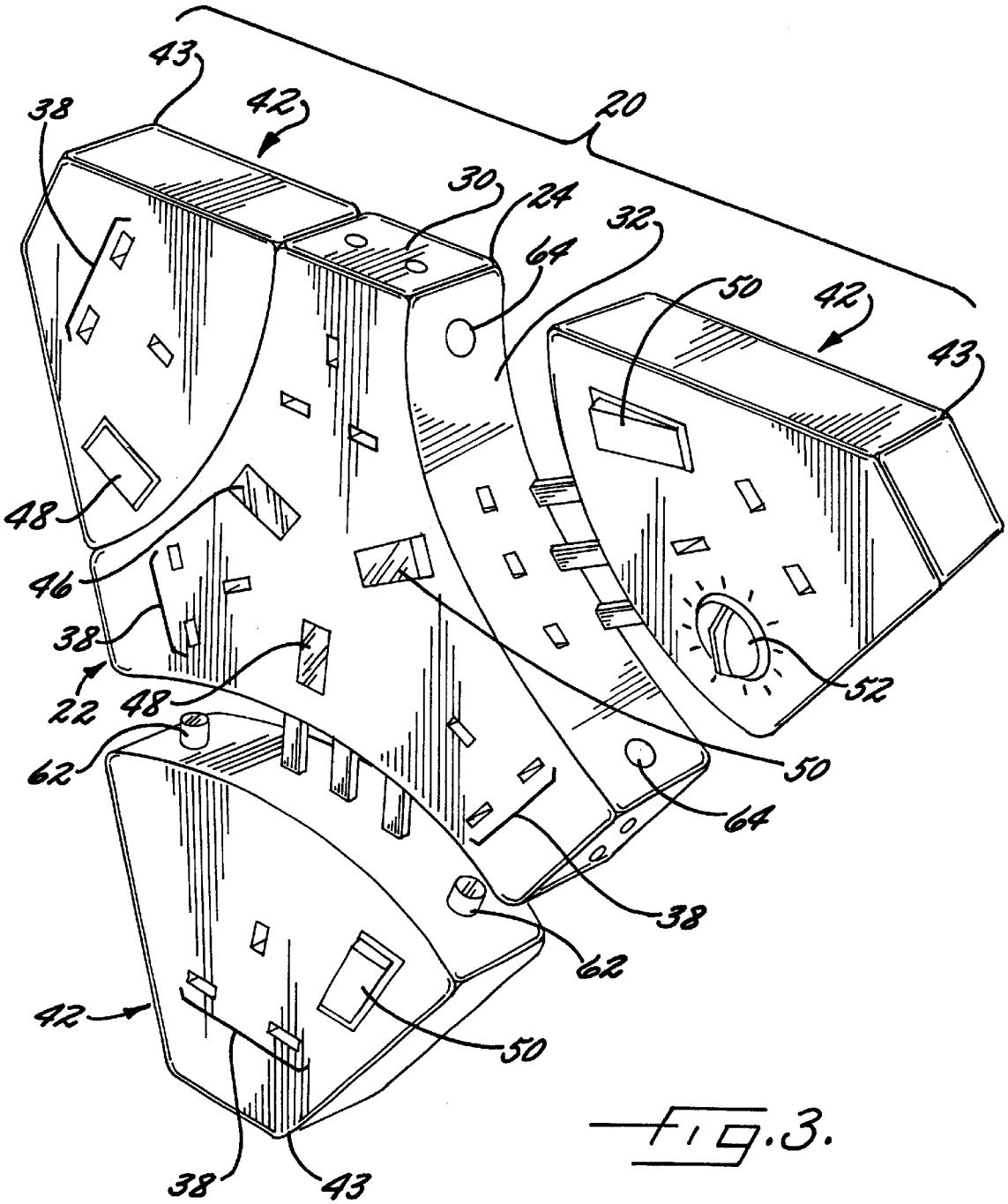
FIG. 3 is an exploded perspective view of the main power distribution module having auxiliary power distribution modules connected thereto; the various modules are shown having connector receptacles configured for 30 Amp electrical power line, and having added features such as a timer switch, a power disconnect switch, a power overload warning indicator and a circuit breaker.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The present invention embodies an apparatus for distributing power 20 having a main power distribution module 22 including a main housing 24 whereon a plurality of auxiliary power line connector receptacles 38 are formed, having at least one auxiliary power distribution module 42 which matingly connects with the main housing 24 in a generally arcuate recess 44, and an associated method.

The main power distribution module 22 connects to a wall electrical outlet for tapping power from a main power supply line 15, as illustrated in FIG. 1. The main power distribution module 22, shown in side view in FIG. 2 connecting to a main power supply line 15, also includes a main power line connector 34 having a plurality of main power line connector pins 36 extending from the bottom wall 26, for electrically engaging with the main power supply line 15. The power obtained from the main power supply line 15 is distributed within the main power distribution module 22 to multiple auxiliary power line connector receptacles 38 formed on the top wall 28 and side walls 32, 34 of the main housing 24.

The main power distribution module 22 has a main housing 24 which includes a bottom wall 26, a top wall 28, three substantially planar spaced-apart side walls 30, and three recessed spaced-apart side walls 32 each connected to and extending between two of the three substantially planar spaced-apart side walls 30. The combination of the three substantially planar side walls 30 and the three recessed side walls 32 defines outer side wall peripheries connected to and extending between the bottom wall 26 and top wall 28 of the main housing 24. Each one of the three recessed spaced-apart side walls 32 forms a generally arcuate recess 44 extending inwardly from an imaginary plane extending between two side edges of two of the three substantially planar side walls 30. The arcuate recess 44 is a concave hollow in the periphery of the main housing 24, best shown in FIG. 1. Within the arcuate recess 44 there is an auxiliary power line connector receptacle 38 which is formed in the recessed spaced-apart side wall 32. This auxiliary power line connector receptacle 38 is for receiving the auxiliary power line connector pins 40 extending from the auxiliary housing 43 of the auxiliary power distribution module 42. The auxiliary housing 43 has convex peripheral side wall which is complementary to and matingly fits with the concave hollow of the arcuate recess 44, the auxiliary power line connector pins 40 connecting to the connector receptacle 38.

Figure 8:
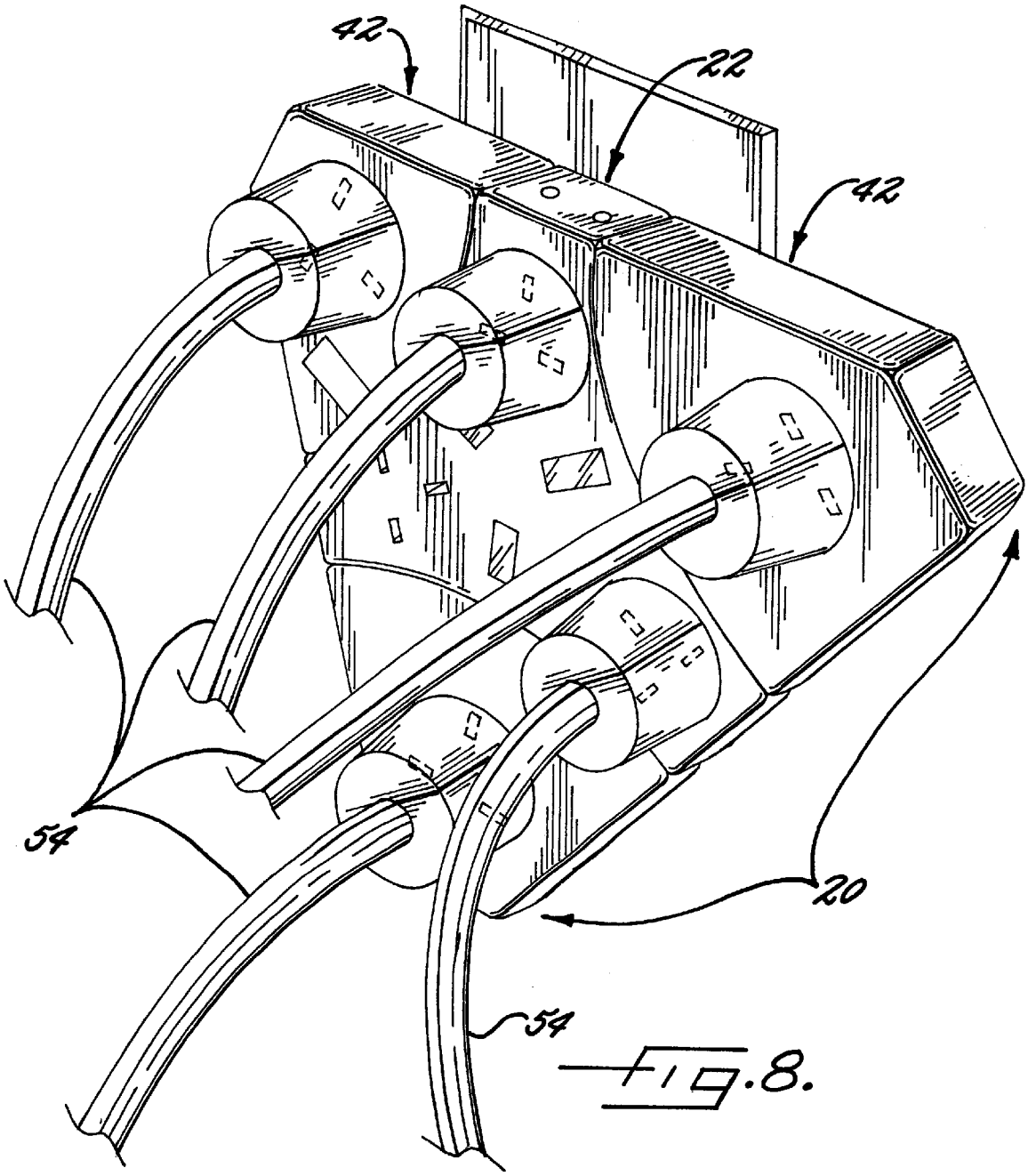
FIG. 8 is an exploded perspective view of the main power distribution module connected to a wall outlet for a main power supply line, having three auxiliary power distribution modules and a plurality of auxiliary power lines connected thereto.
Figure 9A:
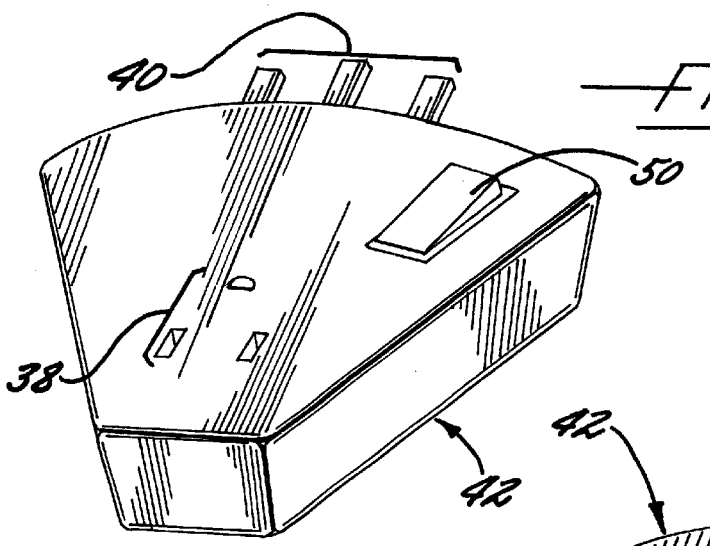
FIG. 9 illustrates auxiliary power distribution modules in various configurations, including: 9(*a*) in 110 Volts configuration and having a power disconnect switch; 9(*b*) in 110 Volts configuration, 30 Amp, having a timer switch and a power disconnect switch; 9(*c*) in 12 Volts D.C. configuration and having a power disconnect switch; and 9(*d*) in 110 Volts, 30 Amp configuration, and having a power disconnect switch.
Figure 9B:
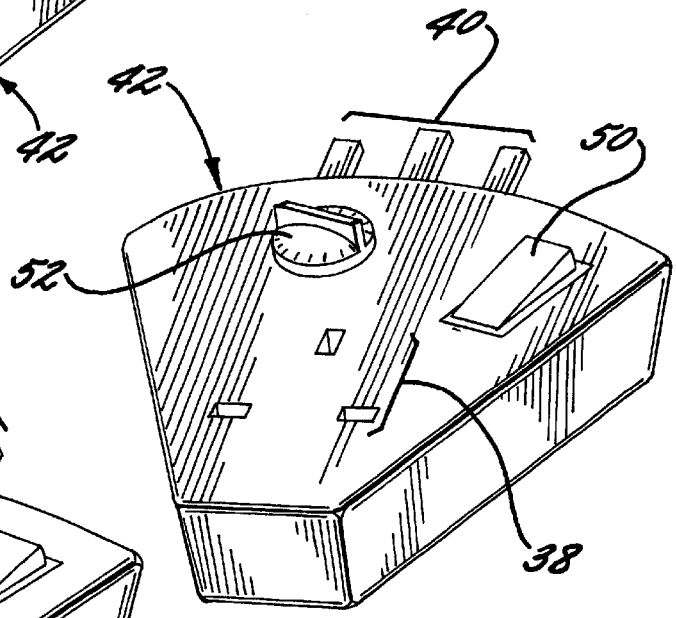
Figure 9C:
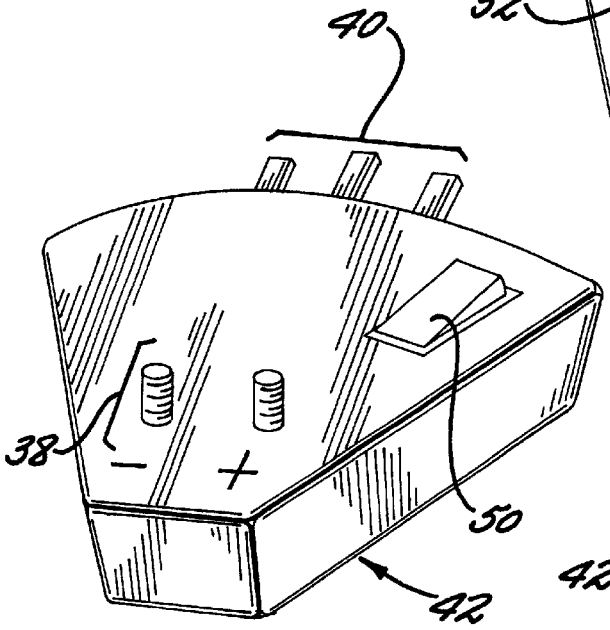
Figure 9D:
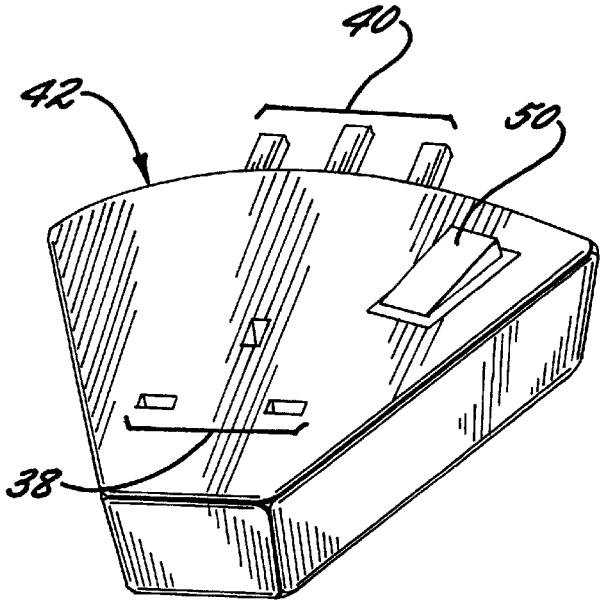

In addition, as best seen in FIG. 3, the convex side wall of the auxiliary housing 43 is disposed with two small pegs 62 which fit into two corresponding small holes 64 located on the recessed side wall 32 which forms the arcuate recess 44 of the main housing 24, thus preventing rotational movement of these surfaces relative to each other, once they are mated. Thus, the novel shape of the apparatus for distributing power 20 provides the useful function of allowing the connection of auxiliary power distribution modules 42 to the main power distribution module 22 in such a way that the apparatus retains a relatively flat profile, which is best illustrated in FIGS. 3 and 8.

The main housing 24 has a plurality of auxiliary power line connector receptacles 38 preferably formed on its top wall 28, each auxiliary power line connector receptacle being defined by a plurality of openings for receiving a plurality of auxiliary power line connector pins 40 therein, each said opening having at least one conductor for electrically connecting the corresponding auxiliary power line connector pin to the main power line connector 34 for conducting and distributing power from the main power supply line 15 to the auxiliary power line connector pin. As shown in the accompanying figures, the main housing 24 provides multiple connector receptacles 38 for receiving the connector pins 40 of a plurality of auxiliary power lines 54 which may be connected to the main power distribution module 22. The top wall 28 of the main housing 24 provides up to three connector receptacles 38 for connecting auxiliary power lines 54. As illustrated in FIG. 3, the top wall 28 of the main housing 24 may also include added features, such as a power disconnect switch 50, a power overload warning indicator 46, a circuit breaker 48, a timer switch 52, or any combination of these devices, as understood by those skilled in the art. The main housing 24 also has connector receptacles 38 formed in the side walls 32, 34 defining the periphery of the module, the receptacles serving for connecting auxiliary power distribution modules 42, as shown in FIG. 3. The main housing 24 includes fasteners 60 on the planar spaced-apart side walls 30, however, the housing may be held together by other methods understood by those skilled in the art.

An auxiliary power distribution module 42 has an auxiliary housing 43 having an auxiliary power line connector receptacle 38 formed on its top wall 28, as illustrated in FIG. 3. Each auxiliary power distribution module 42 may additionally be disposed with a power disconnect switch 50, a power overload warning indicator 46, a circuit breaker 48, a timer switch 52, or a combination of these devices, best shown in FIG. 9. As further illustrated in FIGS. 3, 4 and 9, an auxiliary housing 43 has a pie shape having a truncated apex, its generally convex peripheral side wall having auxiliary power line connector pins 40 and being matingly complementary in shape to the generally arcuate recess 44 of the periphery of the main housing 24, as described above. The matingly complementary fit between the peripheries of the auxiliary housing 43 and the main housing 24 provides the useful function of allowing connection of multiple auxiliary power distribution modules 42 to the main power distribution module 22, while maintaining a relatively flat profile. The apparatus for distributing power 20 is, thus, unobtrusively positioned close to the wall, as best shown in FIGS. 3 and 8.

Figure 4:
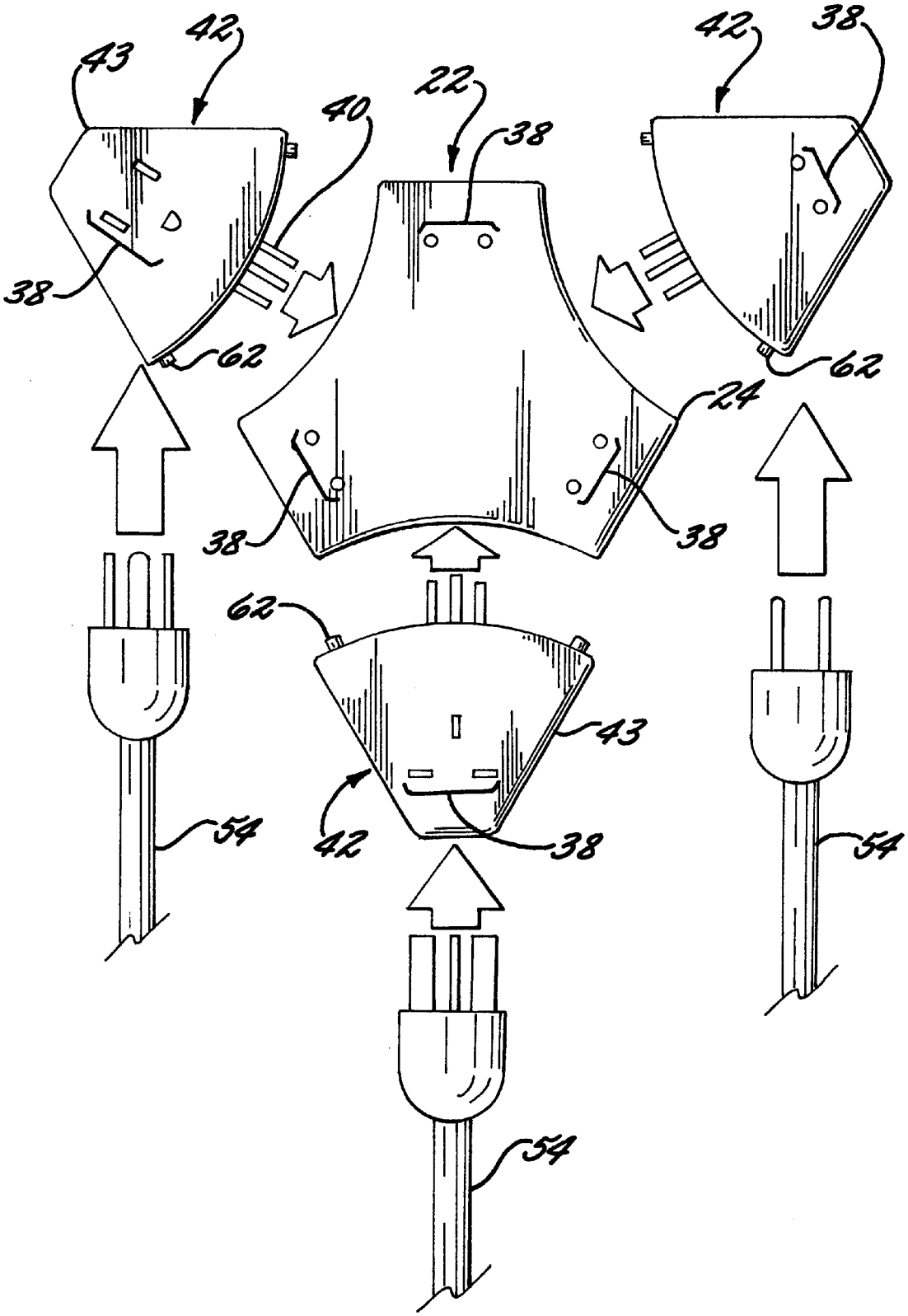
FIG. 4 is an exploded top view of the main housing with associated auxiliary power distribution modules, illustrating the manner in which auxiliary power lines connect to the auxiliary power distribution modules and these, in turn, connect to the main power distribution module.
Figure 7:
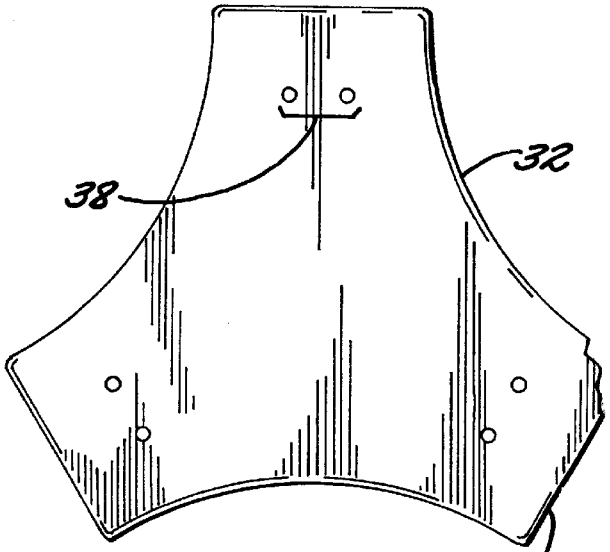
FIG. 7 is a top plan view of the main power distribution module, wherein the power line connector receptacles are configured for 220 Volts power.
Figure 6:
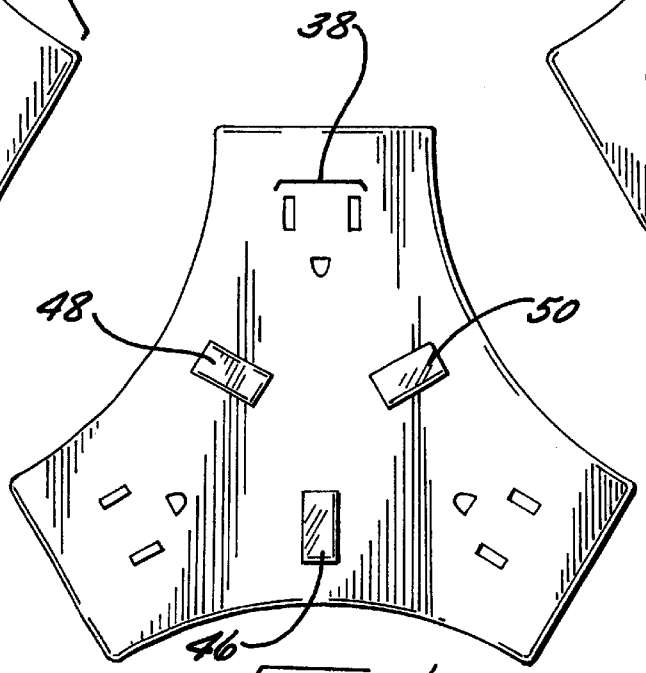
FIG. 6 is a top plan view of the main power distribution module, further including a power disconnect switch, a power overload warning indicator and a circuit breaker.
Figure 5:
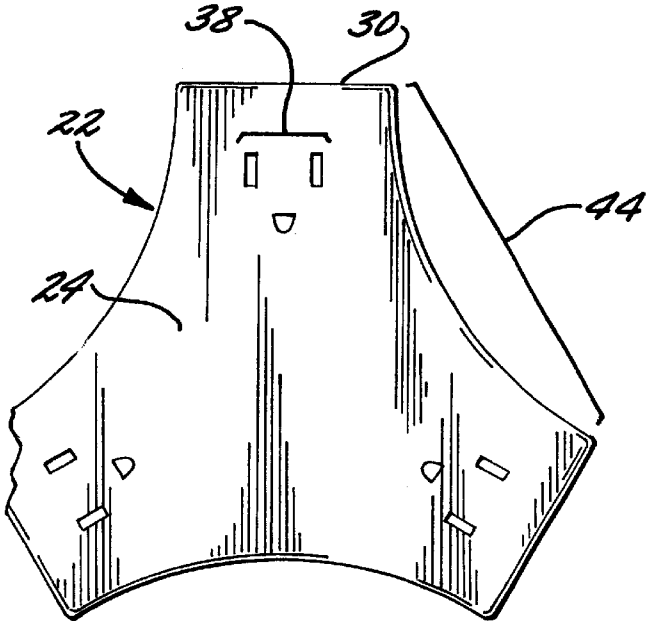
FIG. 5 is a top plan view of the main power distribution module, having auxiliary power line connector receptacles configured for 110 Volts power.

The apparatus for distributing power 20 of the present invention provides great flexibility of use, having several possible functions and attachments, as shown in FIGS. 4 through 9. FIG. 4 shows how the main power line connector module 22 may be used by itself to distribute power from a main power supply line 15 to several auxiliary power lines 54, or together with one or more auxiliary power distribution modules 42 to provide additional functions and more auxiliary power line connector receptacles 38 for connection of yet other auxiliary power lines 54. FIG. 5 shows the main power distribution module 22 having on its top wall 28 three auxiliary power line connector receptacles 38 configured for standard American 110 Volt power lines, including a ground wire. FIG. 6 shows the same main power distribution module 22, further including three optional functions, a power disconnect switch 50, a circuit breaker 48, and a power overload warning indicator 46. FIG. 7 illustrates a main power distribution module 22 having auxiliary power line connector receptacles 38 configured for standard European 220 Volt power lines FIG. 9 illustrates several possible configurations for the auxiliary power distribution modules 42. FIG. 9*a* shows an auxiliary power distribution module 42 having an auxiliary power line connector receptacle 38 configured for the standard American 110 Volt, 15 Amp auxiliary power line connector, and having a power disconnect switch 50. FIG. 9*b* shows an auxiliary power distribution module 42 configured for connecting a 110 Volt, 30 Amp auxiliary power line, additionally having a power disconnect switch 50 and a timer switch 52 for interrupting power upon expiration of a predetermined amount of time. FIG. 9*c* shows the auxiliary power distribution module 42 configured to convert alternating current to provide 12 Volt direct current at the auxiliary power line connector receptacle 38; this module also includes a power disconnect switch 50. FIG. 9*d* shows an auxiliary power distribution module 42 having a power disconnect switch 50 and a connector receptacle 38 configured for receiving a 110 Volt, 30 Amp auxiliary power line.

Figure 10:
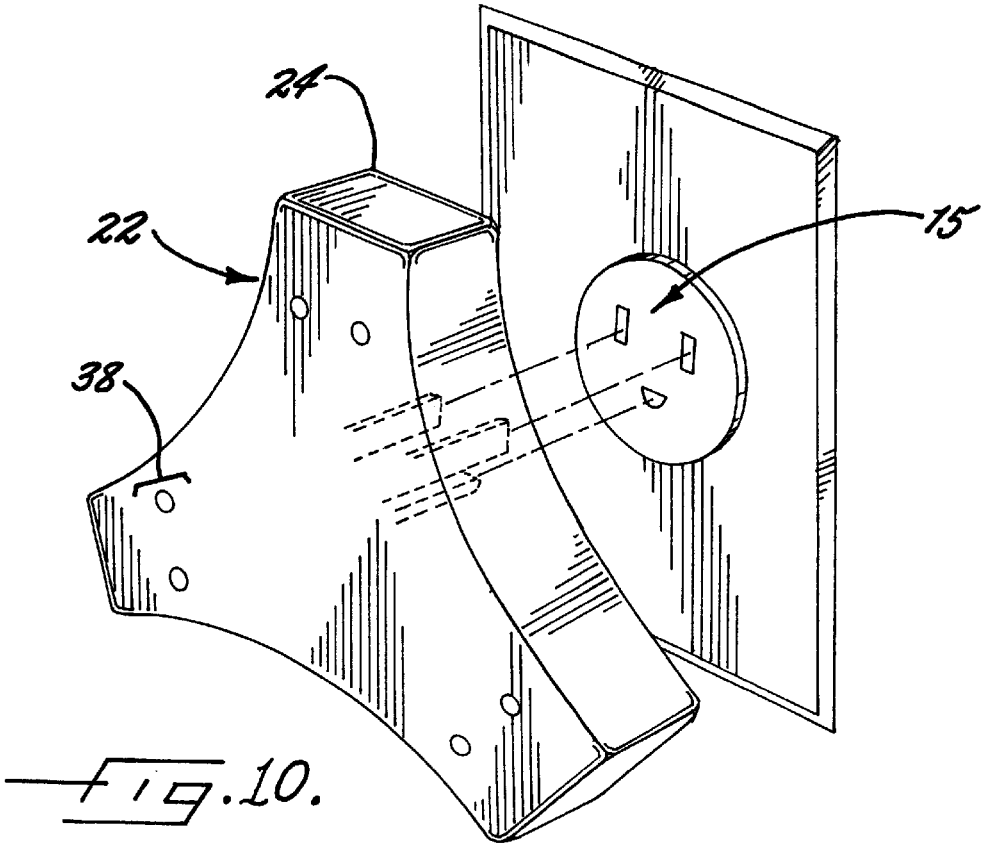
FIG. 10 is an exploded perspective view of the main power distribution module configured to convert power from the standard American 110 Volts at the wall outlet to standard European 220 Volts at the auxiliary power line connector receptacles.
Figure 11:
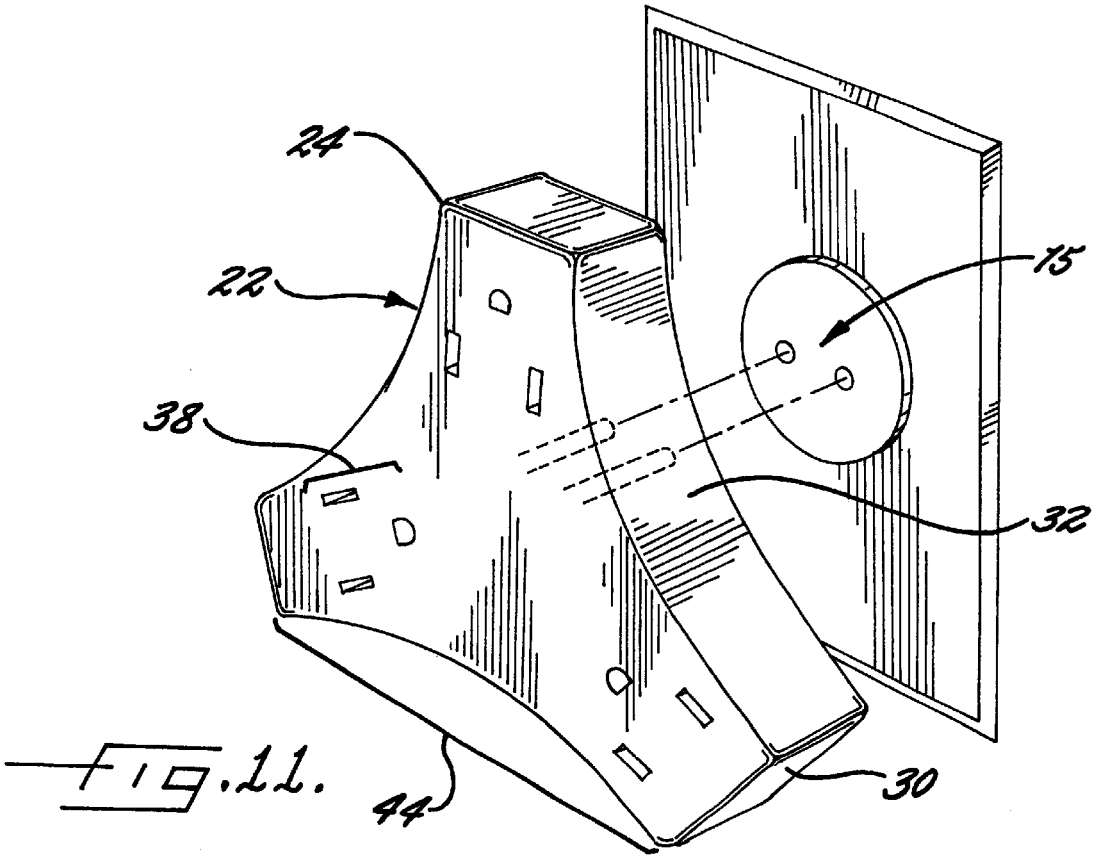
FIG. 11 is an exploded perspective view of the main power distribution module configured to convert power from the standard European 220 Volts at the wall outlet to standard American 110 Volts at the auxiliary power line connector receptacles.
Figure 12:
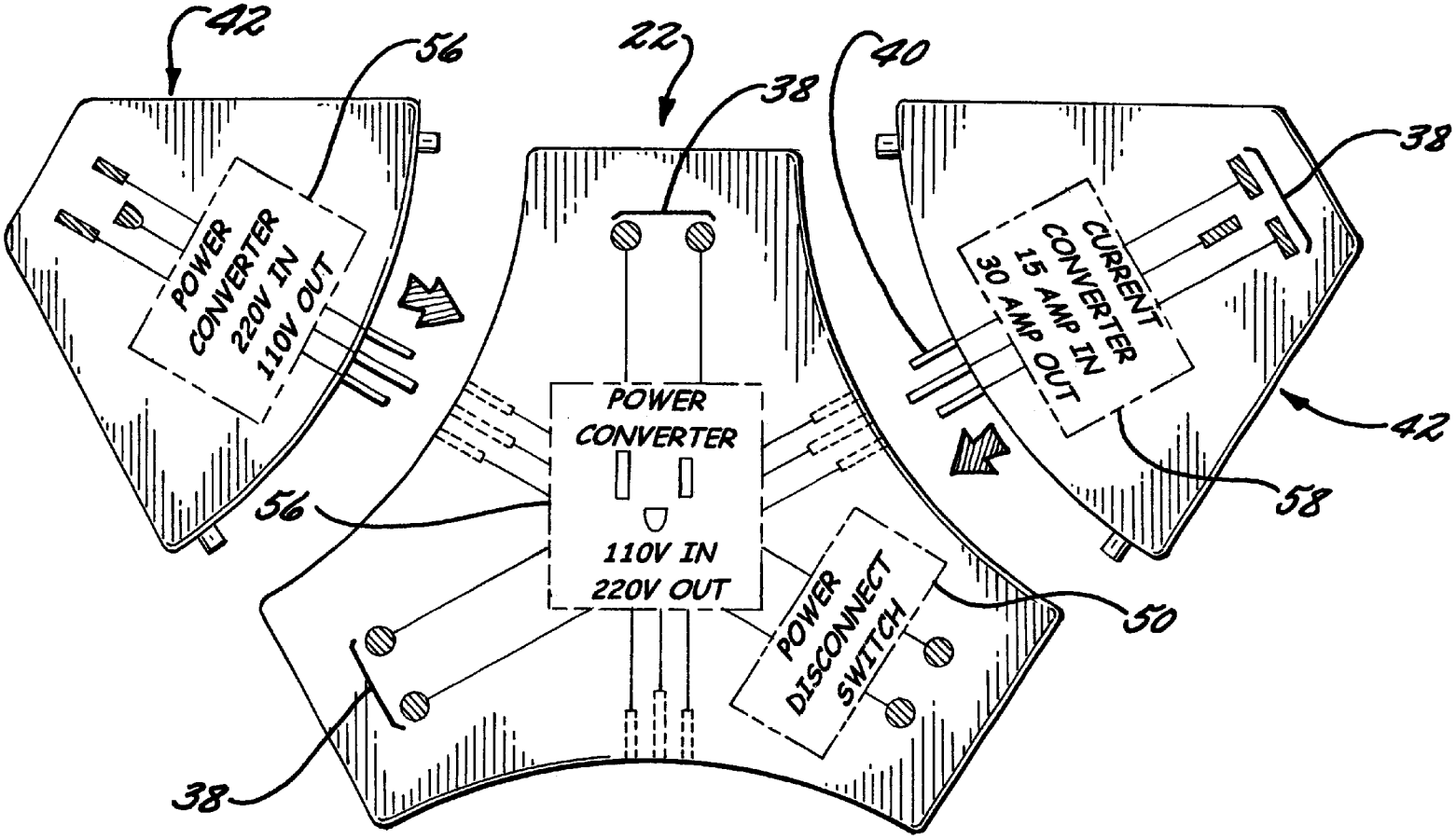
FIG. 12 is a schematic diagram illustrating a power converter to change a 110 Volt input into a 220 Volt output; additionally, this figure shows an auxiliary module having a current converter to change a 15 Amp input to a 30 Amp output, and a second auxiliary module having a power converter to change 220 Volt input to 110 Volt output.

The power and current converters are further shown in FIGS. 10 through 13. FIG. 10 shows a main power distribution module 22 configured to connect to a main power supply line 15 carrying 110 Volt power and auxiliary power line connector receptacles 38 on the main housing 24 configured to receive the connector pins for a 220 Volt auxiliary power line. FIG. 11 shows a main power distribution module 22 configured for converting 220 Volt power from the main power supply line 15 to 110 Volt power at the auxiliary power line connector receptacles 38. A power converter to convert 110 Volt power to 220 Volt is also illustrated in the schematic view shown in FIG. 12. Additionally, FIG. 12 depicts two auxiliary power distribution modules 42, one having a current converter 58, and the second having a power converter 56. Also, a power converter to convert 110 Volt or 220 Volt alternating current to 12 Volt direct current, as known to those skilled in the art, may be included within the main power distribution module 22 or within the auxiliary power distribution module 42, the latter configuration resulting in the auxiliary module illustrated in FIG. 9*c*.

Figure 13:
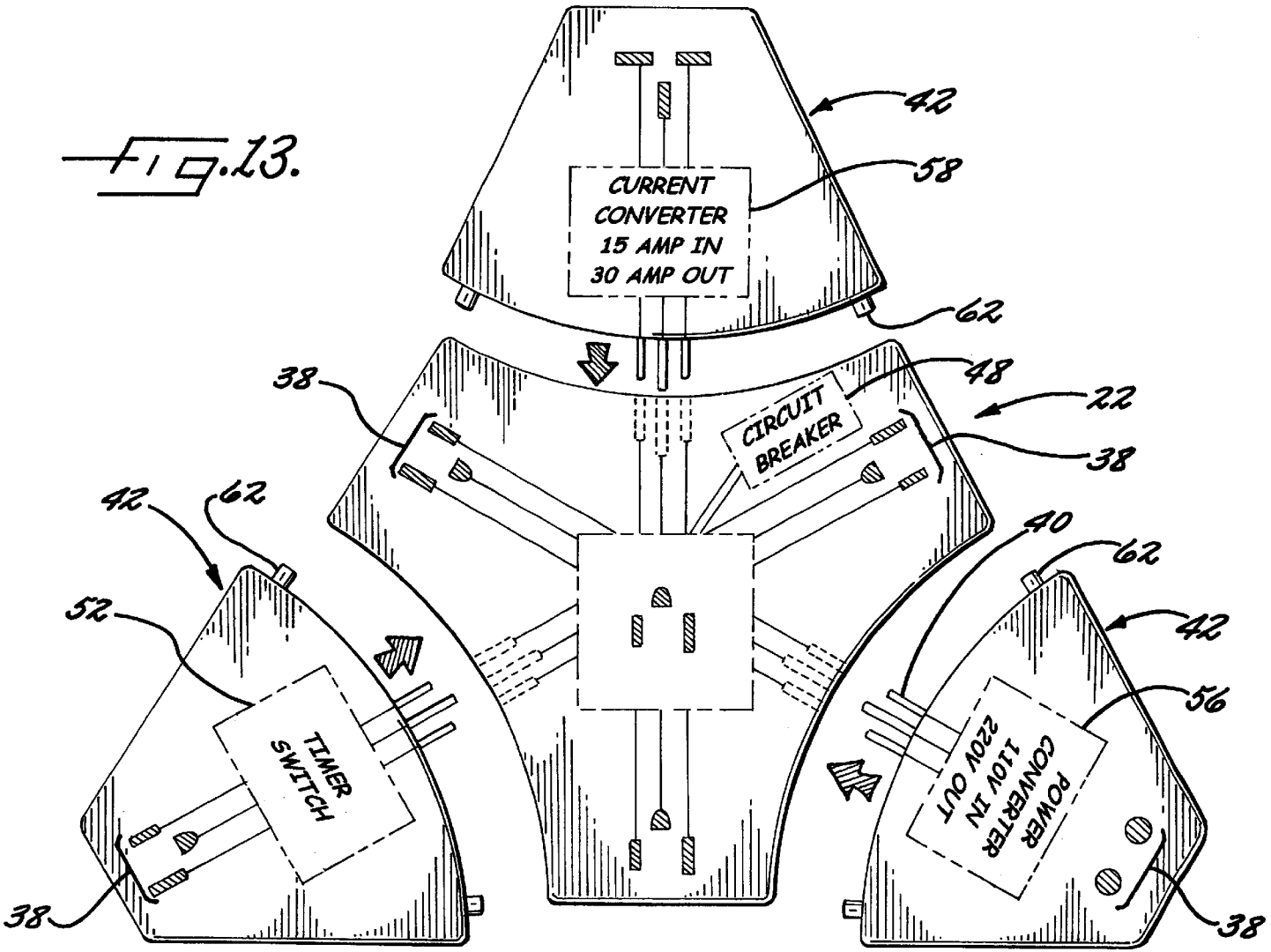
FIG. 13 is a schematic diagram showing the electrical connections from a main power distribution module having a circuit breaker, to its three associated auxiliary modules, each auxiliary module having one power function device, such as a current converter, a power converter or a timer switch.

The electrical connections from a main power distribution module 22 to its three associated auxiliary modules 42 are shown schematically in FIG. 13. The main power distribution module 22 is shown in FIG. 13 having a circuit breaker 48 for interrupting power responsive to a power overload. In addition, FIG. 13 illustrates several possible power function devices on the auxiliary power distribution modules 42, each auxiliary module shown having a power function device such as a current converter 58, a power converter 56 or a timer switch 52.

As illustrated in FIGS. 1 through 13, the present invention also includes methods for distributing power from a main power supply line by electrically connecting a main power distribution module to the main power supply line, electrically connecting at least one auxiliary power distribution module to the main power distribution module so that an outer surface of the auxiliary power distribution module abuttingly contacts an outer surface of the main power distribution module, and by providing a power function device on the auxiliary power distribution module for responsively interacting with the power being distributed from the main power supply line to the auxiliary power distribution module. The main power distribution module used in the method includes a main housing having a bottom wall, a top wall, three substantially planar, spaced-apart side walls and three recessed, spaced-apart side walls each connected to and extending between two of the three substantially planar, spaced-apart side walls so that the combination of the three substantially planar side walls and the three recessed side walls defines outer side wall peripheries connected to and extending between the bottom and top walls. As used in the method, at least one of the three recessed, spaced-apart side walls defines a concavity in the outer side wall peripheries, the concavity having an auxiliary power line connector receptacle formed therein for receiving an auxiliary power distribution module. In addition, the auxiliary power distribution module of the method includes an outer side wall periphery having a convexity for matingly connecting with the concavity of the main housing, the convexity further including a plurality of auxiliary power line connector pins for electrically connecting with the auxiliary power line connector receptacle formed in the concavity.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An apparatus for distributing power from a main power supply line, the apparatus comprising:

a) a main power distribution module having a main housing including a bottom wall, a top wall, three substantially planar spaced-apart side walls, and three recessed spaced-apart side walls each connected to and extending between two of the three substantially planar spaced-apart side walls so that the combination of the three substantially planar side walls and the three recessed side walls defines outer side wall peripheries connected to and extending between the bottom and top walls of said main housing, and a main power line connector having a plurality of main power line connector pins extending from said bottom wall for electrically engaging with the main power supply line;

b) a plurality of auxiliary power line connector receptacles formed in said main housing, each auxiliary power line connector receptacle defined by a plurality of openings for receiving a plurality of auxiliary power line connector pins therein, each said opening having at least one conductor for electrically connecting the corresponding auxiliary power line connector pin to the main power line connector for conducting and distributing power from the main power supply line to the auxiliary power line connector pin; and c) at least one auxiliary power distribution module, said auxiliary power distribution module including an auxiliary housing, a plurality of auxiliary power line connector pins extending therefrom for electrically engaging with one of the plurality of auxiliary power line connector receptacles of said main housing, and at least one auxiliary power line connector receptacle for receiving a plurality of auxiliary power line connector pins.

2. An apparatus as defined in claim 1, wherein at least one of the three recessed spaced-apart side walls of said main housing comprises a generally arcuate recess extending inwardly from an imaginary plane extending between two side edges of two of the three substantially planar side walls.

3. An apparatus as defined in claim 1, wherein each of the three recessed spaced-apart side walls of said main housing has a generally arcuate recess extending inwardly from an imaginary plane extending between two side edges of two of the three substantially planar side walls.

4. An apparatus as defined in claim 3, wherein each of the bottom and top walls is substantially planar.

5. An apparatus as defined in claim 1, wherein said main housing further comprises a power overload warning indicator electrically connected to said main power line connector for visually indicating an impending power overload from the main power supply line to at least one of said plurality of auxiliary power line connector receptacles.

6. An apparatus as defined in claim 1, wherein said main housing further comprises a circuit breaker electrically connected to said main power line connector for interrupting power from the main power supply line to at least one of said plurality of auxiliary power line connector receptacles in a manner responsive to a power overload.

7. An apparatus as defined in claim 1, wherein said main housing further comprises at least one power disconnect switch electrically connected to said main power line connector for disconnecting power from the main power supply line to at least one of said plurality of auxiliary power line connector receptacles.

8. An apparatus as defined in claim 1, wherein at least one of said plurality of auxiliary housings has a power disconnect switch electrically connected to said main power line connector for disconnecting power from the main power supply line to the at least one auxiliary power line connector receptacle.

9. An apparatus as defined in claim 1, wherein at least one of said plurality of auxiliary housings has a timer switch for disconnecting power from the main power supply line to the at least one auxiliary power line connector receptacle responsive to the expiration of a predetermined amount of time.

10. An apparatus as defined in claim 1, wherein said main power distribution module further comprises a power converter for converting power from 220 Volts of alternating current to 110 Volts of alternating current.

11. An apparatus as defined in claim 1, wherein said main power distribution module further comprises a power converter for converting power from 220 Volts of alternating current to 12 Volts of direct current.

12. An apparatus as defined in claim 1, wherein said main power distribution module further comprises a power converter for converting power from 110 Volts of alternating current to 220 Volts of alternating current.

13. An apparatus as defined in claim 1, wherein said main power distribution module further comprises a power converter for converting power from 110 Volts of alternating current to 12 Volts of direct current.

14. A main power distribution module comprising at least one auxiliary power line connector receptacle, and a power overload warning indicator connected to at least one of the bottom, top, and side walls for indicating an impending power overload from the main power supply line to said auxiliary power line connector receptacle, wherein said main housing comprises a bottom wall, a top wall, three substantially planar, spaced-apart side walls, and three recessed, spaced-apart side walls each connected to and extending between two of said three substantially planar, spaced-apart side walls so that the combination of the three substantially planar side walls and the three recessed side walls defines outer side wall peripheries connected to and extending between the bottom and top walls.

15. A main power distribution module as defined in claim 14, wherein at least one of said three recessed, spaced-apart side walls defines a concavity in the outer side wall peripheries, said concavity having an auxiliary power line connector receptacle formed therein.

16. A main power distribution module as defined in claim 15, further comprising at least one auxiliary power distribution module including an outer side wall periphery having a convexity for matingly connecting with said concavity, said convexity further including a plurality of auxiliary power line connector pins for electrically connecting with said auxiliary power line connector receptacle.

17. A main power distribution module as defined in claim 14, the at least one auxiliary power line connector receptacle and a circuit breaker for interrupting power from a main power supply line to said auxiliary power line connector receptacle in a manner responsive to a power overload.

18. A main power distribution module as defined in claim 14, the at least one auxiliary power line connector receptacle, and a power disconnect switch from manually disconnecting power from a main power supply line to said auxiliary power line connector receptacle in a manual manner.

19. A main power distribution module as defined in claim 14, further comprising at least one auxiliary power line connector receptacle, and a circuit breaker for interrupting power from a main power supply line to said auxiliary power line connector receptacle in a manner responsive to a power overload.

20. A main power distribution module as defined in claim 19, further comprising at least one auxiliary power line connector receptacle, and a power disconnect switch for manually disconnecting power from a main power supply line to said auxiliary power line connector receptacle in a manual manner.

21. An apparatus for distributing power from a power supply line, the apparatus comprising:

a) a main power distribution module including a main housing, said housing having a bottom wall, a top wall, three substantially planar spaced-apart side walls, and three recessed spaced-apart side walls, each of the three recessed spaced-apart side walls connected to and extending between two of the three substantially planar spaced-apart side walls so that the combination of the three substantially planar side walls and the three recessed side walls defines outer side wall peripheries connected to and extending between the bottom and top walls of said housing;

b) at least one auxiliary power line connector receptacle formed in each of the three substantially planar side walls of said housing and defined by a plurality of openings formed in each of the three substantially planar side walls and at least one corresponding electrical conductor associated with each of the plurality of openings for receiving a plurality of power line connector pins therein which distribute power from a power supply line; and c) a power distribution indicator connected to said main housing for visually indicating a distribution of power from an auxiliary power supply line when connected to at least one of the power line connector receptacles.

22. A method of distributing power from a main power supply line, said method comprising:

a) electrically connecting a main power distribution module to the main power supply line, wherein the main power distribution module includes three recessed, spaced-part side walls each connected to and extending between two of three substantially planar, spaced-apart side walls;

b) electrically connecting at least one auxiliary power distribution module to the main power distribution module so that an outer surface of the auxiliary power distribution module abuttingly contacts an outer surface of the main power distribution module; and c) providing a power function device on said auxiliary power distribution module for responsively interacting with the power being distributed from the main power supply line to the auxiliary power distribution module.

23. The method of claim 22 wherein the main power distribution module includes a main housing having:

a) a bottom wall; and b) a top wall;

wherein the combination of the three substantially planar side walls and the three recessed side walls defines outer side wall peripheries connected to and extending between the bottom and top walls.

24. The method of claim 23, wherein at least one of said three recessed, spaced-apart side walls defines a concavity in the outer side wall peripheries, said concavity having an auxiliary power line connector receptacle formed therein for receiving an auxiliary power distribution module.

25. The method of claim 24, wherein said auxiliary power distribution module includes an outer side wall periphery having a convexity for matingly connecting with the concavity of said main housing, the convexity further including a plurality of auxiliary power line connector pins for electrically connecting with the auxiliary power line connector receptacle formed in the concavity.

* * * * *